US005657827A

United States Patent [19]

Roth

[11] Patent Number: 5,657,827

[45] Date of Patent: Aug. 19, 1997

[54] AUGER DRILLING HEAD

[76] Inventor: Rudy Roth, 3556 Boutwell Rd., Lake Worth, Fla. 33461

[21] Appl. No.: 582,653

[22] Filed: Jan. 3, 1996

[51] Int. Cl.[6] ..... E21B 10/26

[52] U.S. Cl. ..... 175/385; 175/394

[58] Field of Search ..... 175/385, 386, 175/394, 335; 299/87

[56] References Cited

U.S. PATENT DOCUMENTS

| | | | |
|---|---|---|---|
| 3,094,178 | 6/1963 | Newbold | 175/394 X |
| 4,046,207 | 9/1977 | Taylor | 175/394 X |
| 5,158,147 | 10/1992 | Pavey et al. | 175/385 |
| 5,427,191 | 6/1995 | Rickards | 175/354 |

*Primary Examiner*—William P. Neuder
*Attorney, Agent, or Firm*—McHale & Slavin, P.A.

[57] ABSTRACT

The instant invention is an improved cutter head with a salvageable end cap for hollow stem augers. The end cap includes a mechanism for retrieval upon completion of a drilling operation thereby allowing the end cap to include various bit formations so as to assist in the drilling operation. The side wall of the cutter head is modified to include a keyhole slot for maintaining of the end cap in a rigid position to prevent rotational movement.

15 Claims, 1 Drawing Sheet

AUGER DRILLING HEAD

FIELD OF THE INVENTION

This invention relates to hollow stem drilling augers and more particularly to an improved cutting head for use with the hollow stem augers, the cutting head having a reusable end plate with centrally disposed cutting blades.

BACKGROUND OF THE INVENTION

Augers are well recognized drilling tools capable of simultaneously drilling and casting a hole in various types of earth constituents. The hollow stem auger is used primarily in the environmental and construction industry and employs a large tubular shaped drilling device that allows for the insertion of core items therein. To allow for ease of a core item insertion, an end cap is provided at the end of a cutting head that is removed after the drilling operation.

The cutter head is critical to the drilling operation employing a variety of cutting bits capable of penetrating the soil when coupled to a conventional drill rig. The cutter head is rotated by the drill rig wherein the cutting bits cooperate to break up the soil during insertion. An auger provides movement of material around the diameter of the drilling rig during insertion and commonly include a flighting section for transferring material upwardly so as to avoid impacting.

A drilling machine is used to force the cutter head into the ground which causes the cutting bits to loosen ground materials such as clay, granite, and the like encountered during the drilling process. Once the cutter head has reached a desired depth, the hollow stem may be used as a central passageway for insertion of a separating screen. The screen is inserted through the hollow stem of the auger and used to knock out the end cap centrally located on the end of the cutter head. The end cap remains at the bottom of the drilled hole while the auger device is removed. Back filling of the hole around the screen is possible while the end cap remains at the bottom of the hole, the screening separating the surrounding soil thereby maintaining a hole for insertion of sampling instruments.

A problem with the hollow stem auger, to which this invention is directed, relates to the end cap which operates a drilling impediment and once the drilling is complete remains at the bottom of the formed hole. If constructed of wood, the end cap may interfere with sampling as wood can concentrate and retain various fluids. If constructed of plastic, the end cap does not disintegrate and operates as a form of pollution.

The use of the centrally disposed end cap places a great strain on the drilling equipment as the cutting bits located around the circumference of the cutting head are required to break up the ground during the drilling process. The end cap, having no drilling surface, operates as an outright impediment during the drilling operation as forward progress must rely upon the bits located along the circumference to loosen any materials directly in the path of the tip.

A cutter head has a flighting section and bit blocks that form the outer most section of the cutter head and are used for reaming of the hole to be drilled. This section takes a tremendous amount of wear as a result of being placed against hard formations during the rotation and advancing of the cutter head. In this manner, the conventional cutter head components tend to wear out quickly if the cutter head is used to drill in hard ground, the chisel bits may wear unevenly and have a tendency to wear on one side.

During insertion of the cutting head the end cap may impact a rock wherein forward motion can not proceed without either moving the cutter head to a new position or allowing the cutter head to "walk" wherein the chipping bits can engage the rock. In either instance, the cutter head is placed in an awkward position placing a strain on the drilling equipment. If the impact against the end cap is severe, the end cap can be dislodged resulting in leakage which may lead to failure of the drilling operation.

U.S. Pat. No. 5,158,147 attempts to address these problems by use of a cutter head having a cutting bit located on the end. The cutting head includes a flighting section mounted on the cutter body having a bit block fixed to the flighting section. The bit block works in conjunction with a first outside chisel bit for rotation about its own axis. While this invention discusses the need for placing of cutting bit along the end, it fails to address the end cap and by design eliminates its usage. The invention does not address the need for drilling operations wherein the end cap is necessary. The result limits the drilling tools effectiveness to ground formations that will not collapse during removal of the auger.

U.S. Pat. No. 5,427,191 sets forth an auger assembly capable of boring hard surfaces, namely rock. As disclosed by the invention, when hard rock formations are encountered conventional drilling rates are severely limited. The problem with the cutter head of the disclosed invention is it prohibits the use of the hollow stem auger. While the device is most beneficial for rock formations, it is unlikely that a rock formation will be found individually without some combination of loose soil. In this manner, while the instant invention may drill through rock, the associated substrate will collapse on the auger hole requiring multiple drilling if not subsequent use of hollow stem auger so as to allow the placement of sampling or testing components as typically used in a hollow stem auger application.

Thus, what is needed in the art is a hollow stem auger cutter head that maintains the use of a knock-out end cap, yet provides provisions for salvaging of the cap after use. In addition, an end cap is needed that remains an integral part of the drilling operation so as to lessen wear and increase drilling operation efficiency.

SUMMARY OF THE INVENTION

The instant invention is an improved cutter head having a reusable end cap. The end cap incorporates at least one cutting blade across the exposed end of the cap so as to provide cutting action during the drilling operation. The cutting blade is carbide tipped for longevity. The blade works in conjunction with conventionally positioned cutting blocks located along the outer circumference of the cutting head. The end cap is secured to the cutting head by a flexible cable allowing the withdrawal of the end cap after a drilling operation.

The cutting blade is maintained in a fixed position by use of keyhole slots located in the side wall which support the cutting bits. Each keyhole slot accepts a portion of the cutting blade to transfer stresses from the blade to the sidewall of the cutter head. By positioning of the end cap flush with the end of the cutter head, the end caps operate in conjunction with the cutting blade to direct material away from the drilling hole to the cutting blocks and associated auger configuration.

When the drilling operation is,completed the end cap can be knocked out as commonly performed with conventional hollow stem auger drilling operations. For instance, a pipe screen may be placed through the hollow stem with a distal end of the screen used to tap out the end cap. As the auger is withdrawn from the drilled hole, the screen remains in place while the flexible cable allows the end cap to be retrieved with the auger. The flexible cable permits the end cap to move around the screen during withdrawal.

Yet another embodiment of the instant invention discloses a collapsible end cap which allows for the salvageable removal of the end cap as previously mentioned, yet contemplates the ability of the end cap to be either hinged or break into multiple pieces thereby allowing removal when larger testing equipment is placed within the hollow stem auger. The end cap may include various interlocking features or a hinged mechanism thereby allowing the removal as previously described. In this manner, the cutting head assists in maintaining the end cap in position during the drilling operation.

Thus, an objective of the instant invention is to utilize the surface area of the end cap by incorporating a carbide tipped cutting blade and further recover the end cap following the drilling operation.

Yet still another objective of the instant invention is to maintain positioning of the cutting blade by use of keyhole slots positioned along the end of the auger head thereby transferring stress from a rotational bit movement to the circumference of the auger drilling machine.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
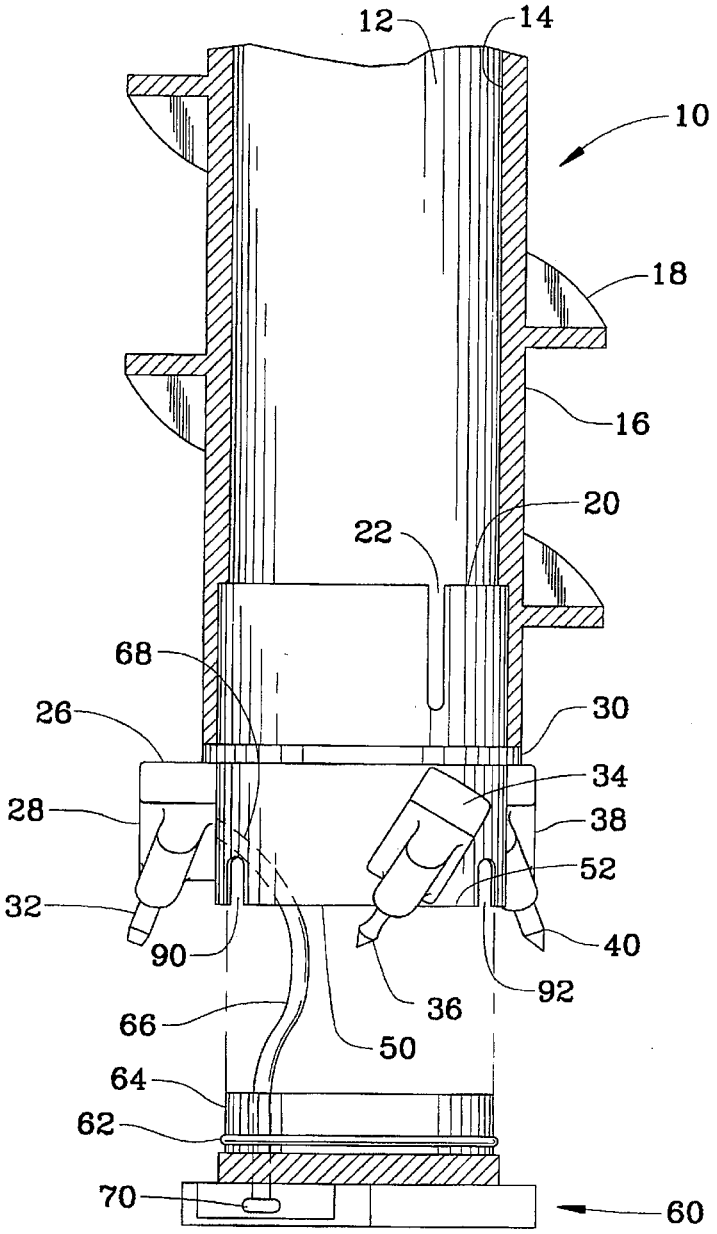
FIG. 1 is cross-sectional and exploded side view of an auger with a cutter tip and an end cap.
Figure 2:
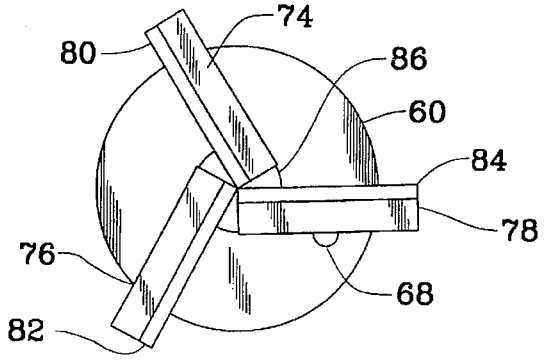
FIG. 2 is an end view of the end cap.

Now referring to FIG. 1, shown is a cross-sectional side view of a hollow stem auger 10 having a central passageway 12 formed by inner side wall 14 and outer side wall 16 forming a nominal thickness therebetween. The central passageway 12 operates as an insertion chamber for items such as pipe screens used when the drilling operation is complete. The auger 10 includes a helical flight 18 which burrows around the side wall 16 and operates to transport loose material upwardly. The auger 10 is fitted with a replaceable cutter head 20. Key-way 22 is operatively associated with an engagement tab located along the inner side wall 14 of the central passageway 12 for locking the cutter head in place.

The cutter head 20 is dimensioned so as to slidably fit within a portion of the central passageway 12 frictionally engaging the inner surface of side wall 14. The cutter head 20 includes a flighting section 26 formed through use of a plurality of bit blocks 28 which are permanently secured to a portion of the cutter head 20 extending outwardly along the end 30 of the auger 10. A first bit block 28 and second bit block 38 is shown with a replaceable chisel point 32. Bit block 34 is shown with a replaceable round chisel point 36. It is noted that it is common for various styles of cutting bits to be secured to the cutter head, the style of which is dependent upon the material to be drilled. Typically, a combination flat and pointed chisel are used wherein a flat chisel is capable of gouging material for removal whereas a pinion point chisel is used for chipping of a rock structure.

The cutter head 20 includes an open aperture 50 located along end 52 of the cutter head 20 wherein the previously described knock-out end cap is commonly positioned. During a drilling operation, as the auger is rotated into the ground, the chisel bits loosen the material as directed along the flighting section and directed to the helical flight for material removal. The end cap prevents material from entering the central passageway 12 so as to maintain the passageway open allowing for subsequent insertion of testing equipment. For example, in a conventional drilling operation once the operation is completed, the cutter head 20 is located at the bottom of the drilled hole and a screen pipe is inserted through the central passageway 12 and used to knock out the end cap located along the end 52 of aperture opening 50. In this manner, the auger can be withdrawn wherein the end cap remains at the bottom of the drilled hole and the screen pipe that was used to knock out the end cap is left in position allowing back filling of the hole. The resulting situation of the prior art is that the cap operates as a flat impediment to the drilling operation providing no drilling capabilities and further operates as a disposable end cap.

The instant invention is an improvement over the prior art having an end cap 60 formed from metal with a means for sealing the circumference. The end cap 60 is defined as a circular disc of nominal thickness having at least one O-ring 62 positionable about the circumference which allows for sealing said end cap to said cutter structure upon insertion into the central passageway 12. The disc is constructed of metal but can be constructed of a shatter resistance composite plastic. An insertion section 64 of the end cap 60 is slidably insertable within the passageway through aperture opening 50 of the cutter head 20. End cap 60 is secured to the cutter head 20 by use of a flexible wire cable 66 permitting retraction of the end cap when the auger device is removed from a drilled hole which eliminates leaving the end cap at the bottom of the drilled hole. A flexible cable is secured to the cutter head 20 preferably by a weld along inner side wall 14 by passing through end cap 60 for weldment securement along cutting edge 70.

The end cap 60 is salvageable through its ability to be withdrawn in combination with the cutter head 20 by use of a flexible wire cable 66. The flexible cable 66 allows the end cap 60 to twist into a vertical position while being withdrawn thereby placing the end cap alongside the insertion screen used for subsequent sampling needs. The end cap 60 includes a plurality of off center placed cutting blades 74, 76, and 78, each having a carbide tip 80, 82, and 84 located along the outer most edge for longevity. It is noted that each end of the bit is secured along a center axis of the end cap 60 using a filling weld 86 so as to prevent dislodgement during a drilling operation. In addition, a portion of cutting blades 74, 76, and 78 are insertable into cutter head 20 keyhole slots 90, 92, and a third keyhole slot, not shown, on the rear of the cutter head. The keyhole slots are capable of absorbing a large load bearing stress during the cutting process thereby preventing the loss of the cutter bits or reliance upon end cap blade attachment. This further operates to maintain the end cap in a secure and sealed position as the bits operate as individual supports along each keyhole slot. During the drilling operation, the cutting blades 74, 76, and 78 are positioned in such configuration causing an outward rotation of material from the end cap toward the bit block and flighting section for subsequent material transport up the helical flight. It should be noted that a single, double, quadruple, or even higher multiple blade configuration is possible with each blade providing various degrees of material removal thereby enhancing auger operation. In yet another embodiment, the end cap is made of a hinged material allowing folding or splitting of the end cap wherein bit configuration allows for an inward folding formation upon removal from the cutter head. In such an embodiment, the cutter head provides support for the end cap while the auger operation is taking place and upon removal of the end cap from the cutter head, the folding of the cap allows for a minimal restriction during removal.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A cutter head for a hollow-stem auger comprising:

a cutter housing formed from a cylindrical tube defining a central passageway, said tube having an inner surface and an outer surface with a continuous side wall of nominal thickness therebetween, said cutter housing including a plurality of spaced apart cutting blocks positioned on an outer circumference of said cutter housing, each said cutting block having a replaceable tool bit operatively associated therewith;

an end cap defined by an inner side wall and an outer side wall with a side edge therebetween, said side edge of a diameter sized for slidable insertion into said central passageway;

at least one cutting blade secured to said outer side wall of said end cap, said cutter housing having at least one keyhole slot to accommodate said cutting blade to provide rotational securement of said end cap;

a flexible cable having a proximal end permanently secured to said cutter housing and a distal end permanently secured to said end cap said cable is of sufficient length allowing said end cap to be moved from an operating position wherein said end cap seals said central passageway to a vertical position allowing said end cap to be placed perpendicular to said cutter structure; and means for coupling said cutter housing to a conventional subterranean drilling auger capable of rotating said cutter housing about a longitudinal axis defined by said central passageway.

2. The cutter head according to claim 1 wherein said cutter blade comprises three cutting blocks, each said cutting block having a width, a height, and a length, said length extending radially outward beyond said end cap side edge.

3. The cutter head according to claim 2 wherein each said cutting block includes a carbide tip mounted along the length of each block providing a height to each said block.

4. The cutter head according to claim 1 wherein said end cap is defined as a circular disc of nominal thickness having a means for sealing said end cap to said central passageway of said cutter housing.

5. The cutter head according to claim 1 wherein said end cap is defined as a circular disc of nominal thickness constructed from at least two interlocking pieces having a means for sealing said end cap to said central passageway of said cutter housing.

6. The cutter head according to claim 4 wherein said means for sealing is defined as an O-ring positioned along the outer circumference of said end cap.

7. The cutter head according to claim 1 wherein said cable is of sufficient length allowing said end cap to be moved from an operating position wherein said end cap seals said central passageway to a vertical position allowing said end cap to be placed perpendicular to said cutter structure.

8. A cutter head for a hollow-stem auger comprising:

a cutter housing formed from a cylindrical tube defining a central passageway, said tube having an inner-surface and an outer surface with a continuous side wall of nominal thickness therebetween, said cutter housing including a plurality of spaced apart cutting blocks positioned on an outer circumference of said cutter housing, each said cutting block having a replaceable tool bit operatively associated therewith;

an end cap defined by a circular disc of nominal thickness having an inner side wall and an outer side wall with a continuous side edge therebetween, said side edge of a diameter sized for slidable insertion into said central passageway with an O-ring providing a seal between said end cap and said central passageway;

at least one cutting blade secured to said outer side wall of said end cap;

a flexible cable having a proximal end permanently secured to said cutter housing and a distal end permanently secured to said end cap, said cable is of sufficient length allowing said end cap to be moved from an operating position wherein said end cap seals said central passageway to a vertical position allowing said end cap to be placed perpendicular to said cutter structure;

means for securing said end cap to said cutter housing; and means for coupling said cutter housing to a conventional subterranean drilling auger capable of rotating said cutter housing about a longitudinal axis defined by said central passageway.

9. The cutter head according to claim 8 wherein said cutter housing includes at least one keyhole slot to accommodate each said cutting blade whereby said slot provides rotational securement of said end cap during a drilling operation.

10. The cutter head according to claim 8 wherein said cutter blade comprises three cutting blocks, each said cutting block having a width, a height, and a length, said length extending radially outward beyond said end cap side edge.

11. The cutter head according to claim 10 wherein each said cutting block includes a carbide tip mounted along the length of each block providing a height to each said block.

12. The cutter head according to claim 8 wherein said end cap is constructed of metal.

13. The cutter head according to claim 8 wherein said end cap is constructed of composite plastic.

14. A cutter head for a hollow-stem auger comprising:

a cutter housing formed from a cylindrical tube defining a central passageway, said tube having an inner surface and an outer surface with a continuous side wall of nominal thickness therebetween, said cutter housing including a plurality of spaced apart cutting blocks positioned on an outer circumference of said cutter housing, each said cutting block having a replaceable tool bit operatively associated therewith;

an end cap defined by a circular disc of nominal thickness having an inner side wall and an outer side wall with a continuous side edge therebetween, said side edge of a diameter sized for slidable insertion into said central passageway with an O-ring providing a seal between said end cap and said central passageway;

a cutter blade defined by three cutting blocks secured to said outer side wall of said end cap, each said cutting block having a width, a height, and a length, said length extending radially outward beyond said end cap side edge, each said cutting block having a carbide tip mounted along the length thereof;

a flexible cable having a proximal end permanently secured to said cutter housing and a distal end permanently secured to said end cap, said cable is of sufficient length allowing said end cap to be moved from an operating position wherein said end cap seals said central passageway to a vertical position allowing said end cap to be placed perpendicular to said cutter structure;

means for securing said end cap to said cutter housing; and means for coupling said cutter housing to a conventional subterranean drilling auger capable of rotating said cutter housing about a longitudinal axis defined by said central passageway.

15. The cutter head according to claim 14 wherein said cutter housing includes at least one keyhole slot to accommodate each said cutting blade whereby said slot provides rotational securement of said end cap during a drilling operation.

* * * * *